United States Patent [19]

Letter et al.

[11] Patent Number: 4,631,859

[45] Date of Patent: Dec. 30, 1986

[54] INTEGRAL GRAVE MARKER AND FLOWER RECEPTACLE

[76] Inventors: Gary P. Letter, 113 Laurie Dr.; Raymond J. Letter, 35 Poinsettia Dr., both of Ormond Beach, Fla. 32074; Eugene P. Letter, 47 Aspen St., Daytona Beach, Fla. 32014

[21] Appl. No.: 663,138

[22] Filed: Oct. 22, 1984

[51] Int. Cl.[4] ..... A01G 5/00

[52] U.S. Cl. ..... 47/41.1

[58] Field of Search ..... 47/41.1, 41 R, 41.2, 47/66; 264/259, 269, 267, 273, 263

[56] References Cited

U.S. PATENT DOCUMENTS

| | | | |
|---|---|---|---|
| 1,492,048 | 4/1924 | Reilly | 47/41.1 X |
| 2,052,940 | 9/1936 | Pitcher | 47/41.1 |
| 2,438,802 | 3/1948 | Carlson | 47/41.1 |
| 2,608,028 | 8/1952 | Ross | 47/41.1 |
| 2,754,625 | 7/1956 | Rasmussen | 47/41.1 |
| 2,810,990 | 10/1957 | Wright | 47/41.1 |
| 3,052,065 | 9/1962 | Rettman | 47/41.1 X |
| 3,369,321 | 2/1968 | Blackistone | 47/41.1 |
| 3,660,002 | 5/1972 | Morroni | 47/66 X |
| 3,972,974 | 8/1976 | Pico | 264/273 X |
| 4,016,676 | 4/1977 | Bennick | 47/66 |
| 4,387,534 | 6/1983 | Lewandowski | 47/66 |
| 4,428,168 | 1/1984 | Tomer | 47/41.1 X |

*Primary Examiner*—Robert A. Hafer
*Assistant Examiner*—Danton DeMille
*Attorney, Agent, or Firm*—John J. Byrne; Bradford E. Kile

[57] ABSTRACT

A grave marker and flower receptacle for use in a cemetary includes a base portion of granite or marble having a cylindrical opening. A molded flower receptacle is formed in the cylindrical opening from resin material such as epoxy or polyester which permanently bonds to the base and which overlayes the upper surface of the base in a decorative construction. A method of forming an integral grave marker and flower receptacle is also disclosed whereby a mold insert is positioned in the cylindrical opening in the base. The flower receptacle material is poured into the area between the insert and the opening in the base and a negative impression of the insert is made as the receptacle material hardens to form the flower receptacle. In an alternative embodiment, the molded flower receptacle is formed in combination with a first base section, after which the first section is cemented to the remaining section of the base. The integral grave marker and base flower receptacle of this invention is substantially theft and vandal proof and resists damage from weathering.

9 Claims, 5 Drawing Figures

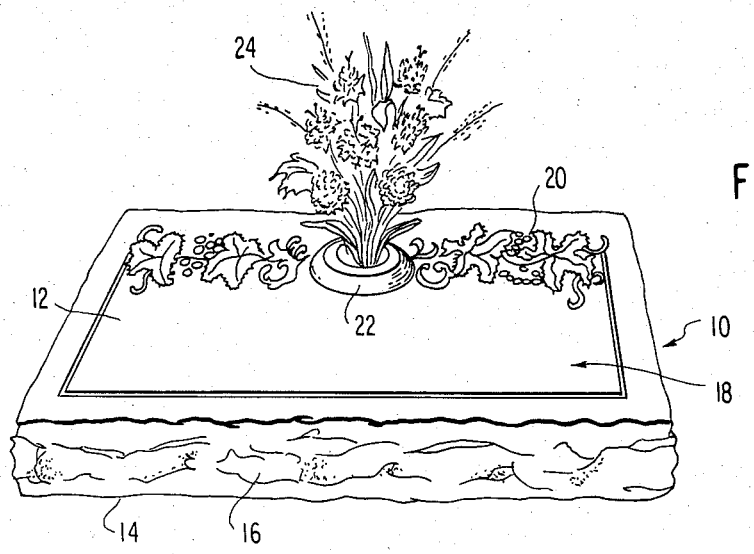
FIG. 1
FIG. 2
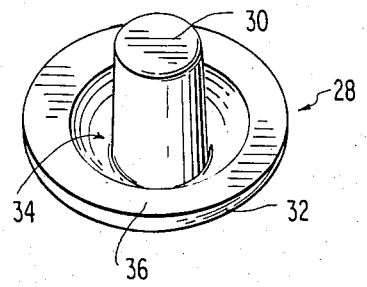
FIG. 3
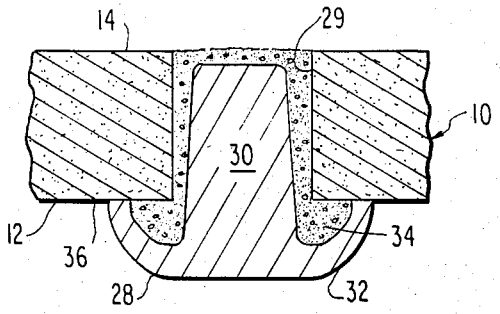
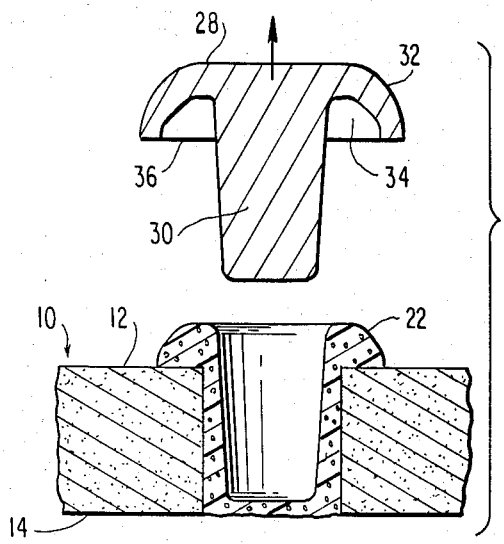
FIG. 4

INTEGRAL GRAVE MARKER AND FLOWER RECEPTACLE

BACKGROUND OF THE INVENTION

This invention relates to an improved memorial grave marker. More particularly, this invention relates to an integral memorial grave marker and decorative flower receptacle which is theft proof, durable and weather resistant.

A basic concept of a memorial grave marker having a flower vase or planter is that flowers will be placed in the receptacle to improve the appearance of the gravesite. A threshold or common denominator of memorial grave markers with flower receptacles is that the receptacle be functional over a relatively long period of time. This requires that the receptacle be not only be theft and vandal proof but also that the receptacle be durable, rust proof and otherwise weather resistent.

Accordingly, over the years the memorial grave marker and monument industry has attempted to provide a combined grave marker and flower receptacle which resists destruction or damage due to theft, vandalism and/or exposure to the weather. In this connection, the memorial grave marker industry has developed a variety of grave marker and flower receptacle arrangements whereby a vase extends upwardly from the ground and is secured at the base to a sunken post near the grave marker. In one assembly, a vase is anchored to a metal post by means of a lock and key arrangement. In another arrangement, a threaded socket assembly is employed in a similar fashion.

Although flower receptacles of the previously described type provide some increase in durability, substantial disadvantages have been occasioned. In this regard, flower receptacles of this type are commonly constructed of metals which weather and rust in the generally exposed enviroment of a cemetary. Also, the anchoring means securing the vase to the metal post after presents considerable difficulty in that a locking assembly is subject to malfunction due to rust or dirt. If a lock is not used, however, the flower vase can be stolen with relative ease. In view of the above problems, flower receptacles of this type are preferably removed from the gravesite when not in use, which creates further difficulties in storage and identification.

A significant advance in the memorial grave marker industry occurred in the relatively recent past when it was determined that a grave marker slab or base could be provided with an area for storing a flower receptacle in a non-operative position. By this arrangement, the grave marker slab can also be used to support the flower receptacle which extends vertically upwardly from the slab in its operative position.

A particular grave marker and flower receptacle arrangement which has obtained at least a degree of industry recognition comprises a first bore having an axis normal to the upper face of the grave marker slab if the slab is laid flat and a second bore concentric with the first bore which opens through the upper surface of the slab and provides a circumferential pocket for a metal flower receptacle. The flower receptacle comprises a cylindrical housing having an opening at one end, projections which extend outwardly from a point intermediate the vertical length of the housing, and a flanged ring which rests on the counterbore of the grave marker slab. In a non-operative position, the open end of the cylindrical housing extends downwardly in the direction of the lower side of the grave marker slab. In an operative position, however, the cylindrical housing extends upwardly from the upper surface of the slab with the housing supported by the outwardly extending projections which rest on the flanged ring. In this manner, the flower receptacle may be stored in a relatively nonexposed position when not in use to discourage theft and reduce weather fatigue.

While such an arrangement, as previously noted, has achieved at least a degree of industry recognition and utilization, room for sufficient improvement remains. In this regard, the flower receptacle may be stolen or damaged relatively easily as the receptacle is not permanently anchored to the slab and may be lifted from the cylindrical opening in the grave marker. Moreover, grave marker and flower receptacle arrangements of this type are relatively complex and costly to manufacture in that a plurality of accurately sized bores in the grave marker slab and complimentary receptacle support structures must be produced.

The problems suggested in the proceeding are not intended to exhaustive, but rather are among many which may tend to reduce the effectiveness of prior grave marker and flower receptacle arrangements. Other noteworthy problems may also exist, however, those presented above should be sufficient to demonstrate that memorial grave markers appearing in the prior art have not been altogether satisfactory.

OBJECTS AND SUMMARY OF THE INVENTION

Objects

It is, therefore, a general object of the invention to provide a memorial grave marker and decorative flower receptacle which will obviate or minimize problems of the type previously described.

It is a particular object of the invention to provide a novel grave marker slab and receptacle wherein the receptacle is substantially theft proof and vandal proof.

It is another object of the invention to provide a grave marker slab and decorative flower receptacle wherein the receptacle is durable and weather resistant.

It is yet another object of the invention to provide a novel grave marker slab and decorative flower receptacle which is simple in construction and relatively inexpensive to produce.

It is still another object of the invention to provide a novel method of manufacturing a memorial grave marker slab and decorative flower receptacle whereby a relatively theft, vandal and weather resistant is produced.

It is a further object of the invention to provide a novel method of manufacturing a grave marker slab and decorative flower receptacle whereby a durable receptacle may be installed in slabs of relatively great weight.

BRIEF SUMMARY OF THE INVENTION

One preferred embodiment of the invention which is intended to accomplish at least some of the foregoing object comprises a memorial grave marker and integral flower receptacle having a base portion with an upper surface and a lower surface and a cylindrical opening extending through a section of the base portion and forming an interior cylindrical wall surface. A molded flower receptacle having an upper section, a cylindrical middle section and a lower section is formed from weather resistant resin material in the area of the cylindrical opening. The upper section of the receptacle overlays and is securely bonded to a portion of the upper surface of the base portion around the cylindrical bore, the cylindrical middle section of the receptacle is securely bonded to the interior wall surface of the cylindrical opening in the base and the lower section of the receptical extends axially across the cylindrical opening in the base to provide a relatively durable and theft proof construction.

In another embodiment, the present invention comprises a method for producing a memorial grave marker and integral flower receptacle having the steps of forming a cylindrical opening in a base portion having an upper surface and the lower surface and an interior wall surface around the cylindrical opening and then placing a portion of a flower receptacle insert into the opening. The insert has an first tongue-shaped section which is axially narrower than the opening in the base portion and which extends into the opening. The insert also contains a second apron section which is axially wider than the opening in the base portion and which overlays the upper surface of the base. After installation of the insert, a synthetic bonding material is poured into the space between the insert and the interior wall surface of the base and allowed to set and harden so that a negative impression of the insert is formed. The insert is then removed from the opening in the base portion, leaving the hardened synthentic bonding material formed in the shape of a flower receptacle and also securely bonded to the interior wall surface of the base portion and to the overlaying area of the upper surface of the base portion to provide a relatively durable and theft proof construction.

In another preferred embodiment, the memorial grave marker and decorative flower receptacle is produced by initially bonding the flower receptable to a first section of the base and then bonding the first section to a second section of the base.

In describing the invention, the term memorial grave marker has been used in particular relation to a flat slab or tablet. It is fully intended, however, that this term also emcompasses other shaped memorial markers of a variety of shapes.

THE DRAWINGS

Other objects and advantages of the present convention will become apparent from the following detailed description of a preferred embodiment taken in conjunction with the accompanying drawings, wherein:

FIG. 1 is an axonometric view of a memorial grave marker slab with an integral decorative flower receptacle produced in accordance with the present convention;

FIG. 2 is an axonometric view of a flower receptacle insert which may be used to form the decorative flower receptacle illustrated in FIG. 1;

FIG. 3 is a cross sectional view of a grave marker slab turned upside down having a cylindrical opening und with the receptacle insert shown in FIG. 2 installed therein and further with a mold material poured into the space between the insert and the marker;

FIG. 4 is a cross sectional view similar to FIG. 3 but with the mold material hardened and bonded to the slab and with the slab turned right side up and the receptacle insert removed;

DETAILED DESCRIPTION

Figure 5:
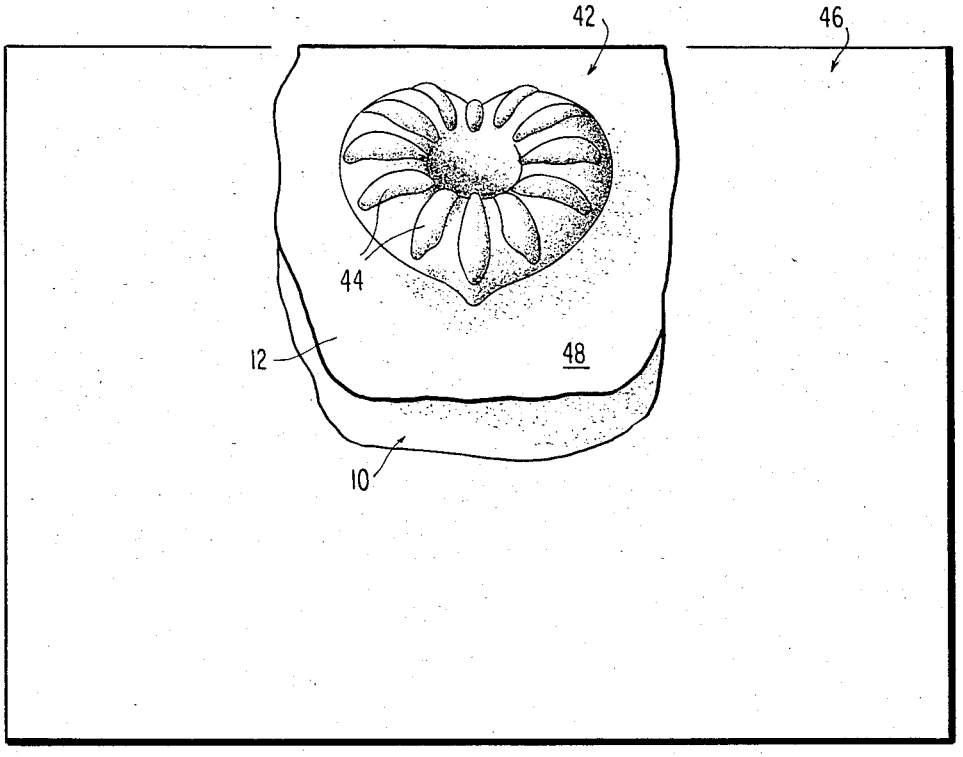
FIG. 5 is an axonometric view of an alternative design of a decorative flower receptacle and further showing a first section of the marker prior to cementing to a remaining portion of the marker.

Referring now the drawings, wherein like numerals indicate like parts, FIG. 1 illustrates a memorial grave marker and integral flower receptacle in accordance with the present invention. A base portion 10 has an upper surface 12 and lower surface 14 and sides 16. An epitaph area 18 is preferably provided for name indicia and the like on the upper surface 12 of the base portion as well as a decorative area 20. Also, a decorative flower receptacle 22 is provided and serves as a vase or planter for flowers 24.

The base portion 10 of the monument grave marker may be constructed of any of the materials commonly known in the art and is preferably either granite or marble. Similarly, the flower receptacle 22 may comprise any weather resistant material which can be molded to the form of a flower receptacle and which after hardening forms a secure bond to the base portion 10. Preferred bonding materials are resins of epoxy or polyesters, and a particularly preferred receptacle material includes a mixture of epoxy resin and aggregates of crushed stone wherein the stone has a particle size of $\frac{1}{8}$ of an inch or less in diameter and is added to the epoxy resin in the proportion of one part of epoxy resin to three parts of stone by volume.

It should be understood that a lesser quantity of aggregate material may be used. It is important, however, that there be sufficient resin present in the receptacle material to completely wet the surface of the base to form a secure bond.

As illustrated in FIGS. 2 through 4, the flower receptacle may be formed by placing insert 28 into a cylindrical opening formed by interior wall 29 in base portion 10. FIG. 3 shows the base portion 10 laying flat in an upside down configuration wherein upper surface 12 faces downwardly during the pouring and hardening of the flower receptacle material, and in FIG. 4 the base 10 is turned right side up and the insert 28 has been removed after the receptacle material has hardened.

The insert 28 may be constructed of any sturdy material which will not bond to the mixture of resin and aggregates, and suitable materials are acrylic, fiberglass, rubber and the like. The insert includes a tongue-shaped section 30 which is of a smaller axial width than the cylindrical opening in base 10 so that upon installation of the insert into the opening circumferention space is provided between section 30 and interior wall portion 29. The mold 28 also has a lower apron section 32 which is axially wider than the cylindrical opening and which is shaped to form a recessed area 34.

To form the flower receptacle, the tongue-shaped section 30 of the insert 28 is placed into the cylindrical opening in the base 10. It is preferred that the base is then turned to the position shown in FIG. 3 wherein the upper surface 12 points downwardly and the base rests on the apron section 32 of insert 28. While in this position, the receptacle material 22 which is preferably a mixture of resin and stone aggregates is poured into the area between the insert 28 and the base 10, filling the recessed area 34 and the area between insert section 30 and the interior wall 29. While in this position, the resinous receptacle material 22 hardens and forms a negative impression of the insert 28 in the recessed area 34. The grave marker is maintained in this position until the resin mixture has set and hardened and bonded to the base portion 10. If required, clamps or belts may be used to maintain the insert in a fixed position with respect to the cylindrical opening during this time. After the receptacle material has hardened, the base 10 is returned to its upright position and insert 28 is removed.

As shown in FIG. 5, the receptacle 42 may be heart-shaped or any other shape appropriate for use in connection with a memorial grave marker. In this figure, receptacle 42 additionally includes decorative ripples 44. It is understood that the receptacle may be further decorated such as by painting to any color desired.

FIG. 5 further illustrates an embodiment of the invention which is especially useful when relatively heavy granite or marble slabs are utilized. In this embodiment, the mold is first formed in a section of the marker 48 as decribed above. The first section 48 is then cemented to the remaining section of the marker 46 to form the final assembly. By this method, the need for manipulating the entire base portion is obviated.

Having described in detail a preferred embodiment of the invention and before continuing with the claim portion of the specification, it may be useful to briefly set forth some of the major advantages of the invention.

SUMMARY OF THE MAJOR ADVANTAGES OF THE INVENTION

In describing a memorial grave marking slab having an integral decorative flower receptacle in accordance with the present invention, those skilled in the art will recognize several advantages which singularly distinguish the subject invention from the heretofore known prior art.

A particular advantage of the subject invention is the provision of a grave marking slab and decorative flower receptacle which is theft and vandal proof and weather resistant. In this connection, in the prior known grave marking arrangements, it was necessary to use a lock or other mechnical anchoring means to secure the flower receptacle to the gravesite. These mechanical anchoring arrangements, however, were subject to malfunction due to rust and/or the presence of dirt in the assembly. Moreover, even with an adequate anchoring arrangement, the flower receptacle was relatively exposed and subject to theft and vandalism. In memorial grave markers wherein a flower receptacle was stored in a nonoperative position within the grave marking slab, the receptacle could still be stolen relatively easily and was generally exposed to the environment when in use.

Another significant advantage of the subject invention is a relatively simple and efficient construction and operation of the grave marker slab and flower receptacle. The flower receptacle is permanently bonded to the grave marker, which strengthens the overall structure. Moreover, the completed monument is a one piece assembly which cannot be easily disassembled and which requires essentially no maintenance.

Still a further advantage of the present invention is that a variety of shapes and sizes of flower receptacles can be produced merely by altering the configuration of the insert. The apron section of the insert can be shaped to form various molds which overlay the upper surface of the slabs. Additionaly, the length of the tongue section of the insert and can fixed to produce a receptacle having either a solid bottom section or an open bottom section for drainage.

Still further, the present invention provides a method for installing an integral flower receptacle into a grave marker slabs which is of relatively great weight and may be difficult to otherwise handle.

In describing the invention, reference has been made to a preferred embodiment. Those skilled in the art, however, and familiar with the disclosure of the subject invention, may recognize additions, deletions, substitutions, modifications, and/or other changes which will fall within the purview of the invention as described in the following claims.

We claim:

1. An integrally combined grave marker and flower receptacle comprising:

a base slab of predetermined depth and having an uniformly cylindrical bore extending therethrough with first and second circular openings respectively disposed on opposing first and second surfaces of the slab;

an integral flower receptacle molded within said cylindrical bore and having a flat end flush with one said opposing surfaces of said slab; said integrally molded flower receptacle being partially shaped by the entire cylindrical surface of said bore forming a partial mold, such that said cylindrical surface of the bore is completely overlaid; whereby said integrally molded flower receptacle being indivisible and bonded to the entire cylindrical surface and having no gaps therebetween such that the base slab and the flower receptacle are effectively one integral and indivisible unit, and a durable and theft proof construction is achieved.

2. A combination as recited in claim 1, wherein said flower receptacle further comprises a section protruding from said cylindrical bore and being molded to a portion of the other of said opposing surfaces.

3. A combination as recited in claim 2, wherein said end of the receptacle extends radially across and completely filling the entire circular opening on said one surface to which the receptacle is flush.

4. A combination as recited in claim 1, 2, or 3, wherein said flower receptacle is molded from a polyester resin.

5. A combination as recited in claim 1, 2, or 3, wherein said flower receptacle is molded from an epoxy resin.

6. A combination as recited in claim 4, wherein said base slab is formed of granite.

7. A combination as recited in claim 4, wherein said base slab is formed of marble.

8. A combination as recited in claim 5, wherein said base slab is formed of granite.

9. A combination as recited in claim 5, wherein said base slab is formed of marble.

* * * * *